US007448714B2

(12) United States Patent
Mizuno

(10) Patent No.: US 7,448,714 B2
(45) Date of Patent: Nov. 11, 2008

(54) INK JET PRINTER, METHOD FOR CONTROLLING INK JET PRINTER, AND COMPUTER PROGRAM PRODUCT FOR INK JET PRINTER

(75) Inventor: Toru Mizuno, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 384 days.

(21) Appl. No.: 11/138,396

(22) Filed: May 27, 2005

(65) Prior Publication Data

US 2005/0264602 A1 Dec. 1, 2005

(30) Foreign Application Priority Data

May 27, 2004 (JP) ..... 2004-157958

(51) Int. Cl.
*B41J 29/393* (2006.01)

(52) U.S. Cl. ..... 347/19

(58) Field of Classification Search ..... 347/19, 347/20, 23, 34
See application file for complete search history.

(56) References Cited

U.S. PATENT DOCUMENTS 5,572,242 A * 11/1996 Fujii et al. ..... 347/23
5,793,388 A * 8/1998 Martinson et al. ..... 347/19
5,896,143 A 4/1999 Matsui et al.
6,398,336 B1 * 6/2002 Yoda et al. ..... 347/23

FOREIGN PATENT DOCUMENTS

JP 2003182052 7/2003

* cited by examiner

*Primary Examiner*—Anh T. N. Vo
(74) *Attorney, Agent, or Firm*—Banner & Witcoff, Ltd.

(57) ABSTRACT

An ink jet printer is provided with an ink jet head, a recovery device, a timer, and a controller. The ink jet head discharges ink. The recovery device executes a recovery action to recover an ink discharging ability of the ink jet head. The timer measures time since a last recovery action of the recovery device. The controller selects an interval based on a printing history of the ink jet printer and controls the recovery device to execute the recovery action when the time measured by the timer becomes equal to the selected interval. The recovery action is performed at an appropriate timing.

16 Claims, 9 Drawing Sheets

INK JET PRINTER, METHOD FOR CONTROLLING INK JET PRINTER, AND COMPUTER PROGRAM PRODUCT FOR INK JET PRINTER

CROSS-REFERENCE TO RELATED APPLICATION

This application claims priority to Japanese Patent Application No. 2004-157958, filed on May 27, 2004, the contents of which are hereby incorporated by reference into the present application.

BACKGROUND OF THE INVENTION

1. Field of the Invention

The present invention relates to an ink jet printer, a method of controlling an ink jet printer, and a computer program product for an ink jet printer.

2. Description of the Related Art

Ink jet printers are well known ink jet printer comprises an ink jet head. The ink jet head has a nozzle for discharging ink. The ink jet head discharges ink and thereby prints on a print medium such as a paper.

If the ink jet printer is not used for a long time, an ink solvent within an ink passage of the ink jet head may evaporate. If the ink solvent evaporates, the viscosity of the ink increases, and the ink will not flow smoothly. If the ink within the ink passage does not flow smoothly, the ink is not discharged smoothly from the ink jet head. If the ink is not discharged smoothly, a printing quality deteriorates.

In order to solve the above problem, a technique in which an ink discharging ability of the ink jet head is recovered automatically was developed (see Japanese Patent Application Publication No. H07-68795; U.S. Pat. No. 5,896,143). In this technique, the ink within the ink passage is sucked away from the nozzle of the ink jet head each time a predetermined time has elapsed. Since ink with increased viscosity is sucked away and the ink discharging ability is therefore recovered, ink can be discharged smoothly at the time of a next printing.

BRIEF SUMMARY OF THE INVENTION

When the recovery action of the ink discharging ability is executed, ink is sucked away from the nozzle. Therefore, the quantity of ink stored in the inkjet printer decreases.

In the conventional technique described above, an interval between one recovery action and a next recovery action is fixed. When a user has not used the printer in the time between the first recovery action and the next recovery action, the ink that was sucked away during the first recovery action was wasted.

The technique taught in the present invention solves the above problem. This technique can reduce the number of times that unnecessary recovery actions are performed.

An ink jet printer described in the present specification has a recovery device for executing an action to recover an ink discharging ability of an ink jet head. The ink jet printer further comprises a timer and a controller. The time measures time that has elapsed since a last recovery action of the recovery device. The controller selects one interval out of a plurality of intervals already provided. The selection of this interval is based on a printing history of the inkjet printer. Furthermore, the controller controls the recovery device to execute the recovery action when the time measured by the timer becomes equal to the selected interval.

In this ink jet printer, the interval of the recovery action is selected based on the printing history of each user. As a result, the recovery action is executed at intervals that correspond to the usage pattern of each user. Since the recovery action is executed at intervals that correspond to each user, unnecessary recovery actions can be reduced.

DETAILED DESCRIPTION OF THE INVENTION

An ink jet printer of a representative embodiment of the present teachings will be described in detail with reference to the drawings.

Figure 1:
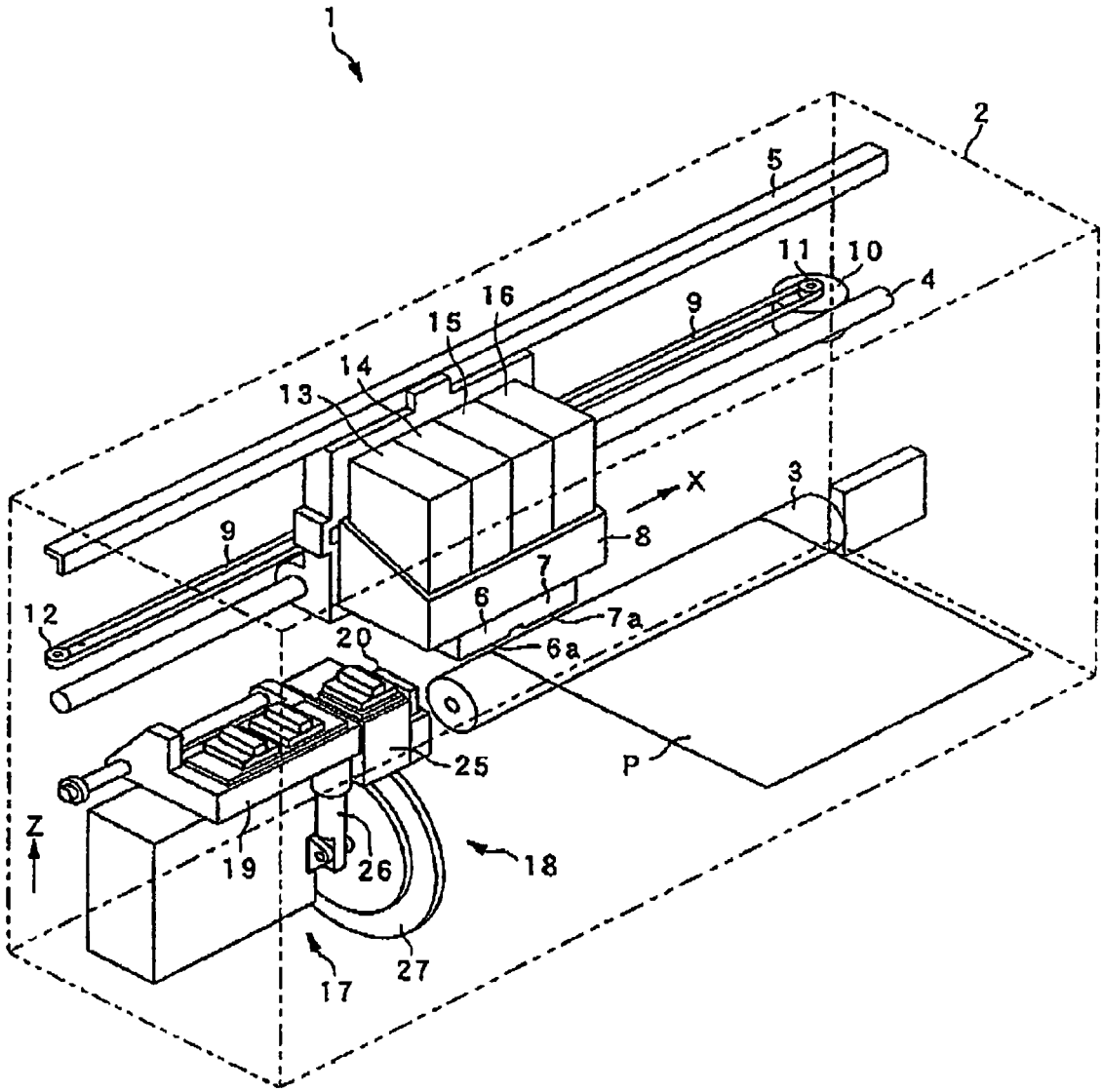
FIG. 1 shows a perspective view of an ink jet printer of a representative embodiment.

FIG. 1 shows a perspective view of an ink jet printer 1 of a representative embodiment. An arrow X in the figure shows the direction of movement of a carriage 8 (to be described). Further, an arrow Z shows the direction of movement of a suction cup unit 25 and a protecting cap 19 (both to be described).

The ink jet printer 1 (this may be referred to hereafter simply as 'printer') comprises a frame 2. The frame 2 has a rectangular parallelepiped shape. In the frame 2, the printer 1 further comprises a first head unit 6, a second head unit 7, and the carriage 8. Ink is discharged from lower faces of the first head unit 6 and the second head unit 7. The carriage 8 supports the first head unit 6 and the second head unit 7. The carriage 8 is capable of moving in the X direction or in a reverse direction thereto (this may be referred to hereafter as the 'main scanning direction').

The printer 1 further comprises a platen roller 3 in the form 2. The platen roller 3 is connected with the frame 2 in a manner allowing rotation. The platen roller 3 deliver a print medium P, such as paper, thin plastic, etc. The printer 1 is a serial printer capable of performing full color printing on the print medium P.

The printer 1 further comprises a guiding roller 4 and a guiding member 5 in the frame 2. The guiding roller 4 is fixed to the frame 2. The guiding roller 4 is connected so as to be parallel with the platen roller 3. The guiding roller 4 supports the carriage 8 such that it can move along the main scanning direction X.

The guiding member 5 is fixed to the fame 2. The guiding member 5 is connected so as to be parallel with the platen roller 3. An upper end face of the carriage 8 makes contact with a lower face of the guiding member 5. This configuration prevents the carriage 8 from moving upwards.

The printer 1 further comprises a belt 9, a carriage motor (referred as CR motor) 10, a driving pulley 11 and a driven pulley 12 in the frame 2.

The driving pulley 11 is located at the right side within the frame 2. The driven pulley 12 is located at the left side within the frame 2. The two pulleys 11 and 12 are located at the same height. The belt 9 is wound across the two pulleys 11 and 12. The belt 9 is connected with the carriage 8. The driving pulley 11 is connected with the CR motor 10. A stepping motor or a DC motor can be adopted as the CR motor 10.

The belt 9 moves between the driving pulley 11 and the driven pulley 12 when the CR motor 10 rotates the driving pulley 11. The movement of the belt 9 moves the carriage 8 along the main scanning direction X.

The printer 1 further comprises ink tans 13, 14, 15, and 16 in the flame 2. The ink tanks 13, 14, 15, and 16 are mounted at the upper part of the carriage 8. The ink tanks 13 and 14 are disposed at the left half of the carriage 8. The ink tanks 13 and 14 supply ink to the fist head unit 6. The ink tank 13 stores black ink. The ink tank 14 stores yellow ink. The ink tanks 15 and 16 are disposed at the right half of the carriage 8. The ink tanks 15 and 16 supply ink to the second head unit 7. The ink tank 15 stores cyan ink. The ink tank 16 stores magenta ink.

The ink tank 13 is removable from the carriage 8. This configuration allows the ink tank 13 to be exchanged when its ink has run out. Similarly, the ink tanks 14, 15, 16 are also removable.

An ink tank exchange sensor 51 (not shown in FIG. 2, but shown in FIG. 3) is mounted on the carriage 8. The ink tank exchange sensor 51 detects the remaining quantities of ink in the ink tanks 13, 14, 15, 16.

The first head unit 6 and the second head unit 7 are connected to a lower part of the carriage 8. As described in FIG. 2, a nozzle ace 6*a* for discharging ink is formed in a lower face of the first head unit 6. A nozzle face 7*a* for discharging ink is formed in a lower face of the second head unit 7. The nozzle faces 6*a* and 7*a* are facing to the platen roller 3. Ink is discharged onto the print medium P from the nozzle faces 6*a* and 7*a*. The first head unit 6 and the second head unit 7 will be described next.

Figure 2:
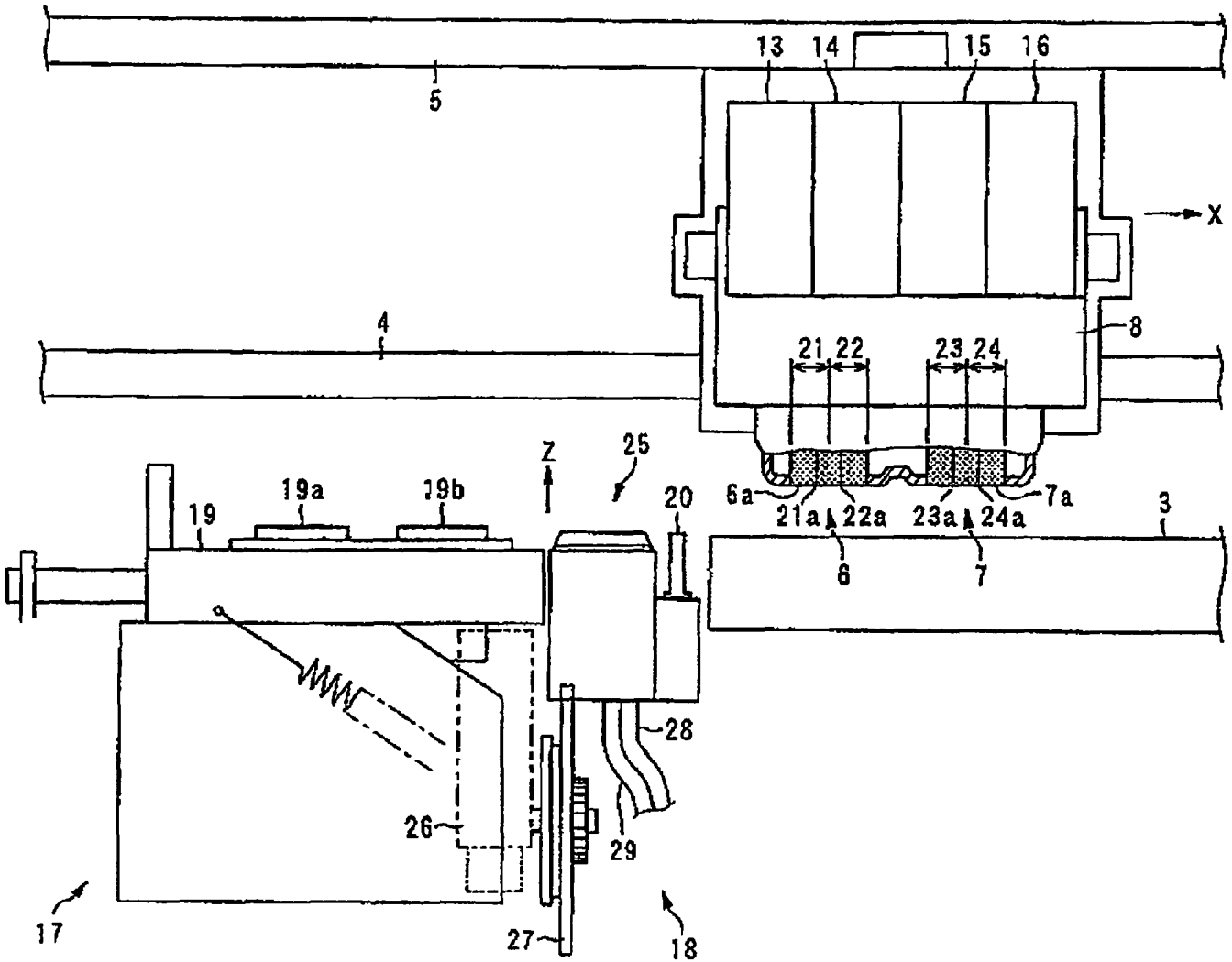
FIG. 2 shows a front view of a portion of the ink jet printer. An ink jet head and a maintenance mechanism are shown.

The configuration of the first head unit 6 and the second head unit 7 will be described in detail with reference to FIG. 2. In FIG. 2, a portion of the first head unit 6 and the second head unit 7 are shown in cross-section. Furthermore, the X direction in FIG. 2 is the direction of movement of the carriage 8 (the main scanning direction). The Z direction is the direction of movement of the suction cap unit 25 and the protecting cap 19 (both to be described).

The first head unit 6 has two ink jet heads 21 and 22. A lower end face of the ink jet head 21 is the nozzle face 6*a*. A lot of nozzles 21*a* are formed in the nozzle face 6*a* of the ink jet head 21. A lower end face of the ink jet head 22 is the nozzle face 6*a*. A lot of nozzles 22*a* are formed in the nozzle face 6*a* of the ink jet head 22.

Ink stored in the ink tank 13 (in the present embodiment, this is black ink) is discharged from the nozzles 21*a*. Ink stored in the ink tank 14 (in the present embodiment, this is yellow ink) is discharged form the nozzles 22*a*.

The second head unit 7 has two ink jet heads 23 and 24. A lower end face of the ink jet head 23 is the nozzle face 7*a* A lot of nozzles 23*a* are formed in the nozzle face 7*a* of the ink jet head 23. A lower end face of the ink jet head 24 is the nozzle face 7*a*. A lot of nozzles 24*a* are formed in the nozzle face 7*a* of the ink jet head 24.

Ink stored in the ink tank 15 (in the present embodiment, this is cyan ink) is discharged from the nozzles 23*a*. Ink stored in the ink tank 16 (in the present embodiment, this is magenta ink) is discharged from the nozzles 24*a*.

Full color printing of the print medium P can be performed by discharging the four colors of ink from the nozzles 21*a* to 24*a* of the inkjet heads 21 to 24.

The printer 1 further comprises a maintenance mechanism (also called a recovery mechanism) 17. The maintenance mechanism 17 recovers an ink discharging ability of the first head unit 6 and the second head unit 7 so that ink can be discharged satisfactorily. When the nozzles 21*a* to 24*a* contain air bubbles due to the ink tanks 13 to 16 being changed, or when the viscosity of the ink within the nozzles 21*a* to 24*a* increases, the maintenance mechanism 17 recovers clear state from such the bad state. The manner in which a maintenance process (also called a recovery process) is executed will be described later.

The maintenance mechanism 17 comprises a suction unit 18, the protecting cap 19, a wiper 20, and a cam member 27. The suction unit 18 comprises a suction cap 25 and a purge pump 26. In FIG. 2, the purge pump 26 is shown by a two-dot chain line. The suction cap 25 is capable of making contact with the nozzle face 6*a* and tightly sealing the nozzles 21*a* and 22*a*. The suction cap 25 is further capable of making contact with the nozzle face 7*a* and tightly sealing the nozzles 23*a* and 24*a*. It cannot make contact the other nozzle face (i.e. 7*a*) when the suction cap 25 is making contact with one nozzle face (i.e. 6*a*). The purge pump 26 generates negative pressure (a suction force) for sucking away ink within the nozzles 21*a* and 22*a* (or the nozzles 23*a* and 24*a*) that are being sealed by the suction cap 25.

As shown in FIG. 2, one end of a tube member 28 is connected with a lower end of the suction cap unit 25. Furthermore, one end of a tube member 29 is connected with the lower end of the suction cap unit 25. The other ends of the tube members 28 and 29 are connected with the purge pump 26 via a valve (not shown). The tube members 28 and 29 join with suction holes of the suction cap 25. The ink sucked away by the suction cap 25 is discharged via the tube members 28 and 29.

The protecting cap 19 is disposed at the left side of the suction cap 25 (the opposite side from the platen roller 3). The protecting cap 19 comprises cap parts 19*a* and 19*b*. The cap part 19*a* covers the nozzle face 6*a*, and the cap part 19*b* covers the nozzle face 7*a*. The protecting cap 19 covers the nozzle aces 6*a* and 7*a* when the printer 1 is not being used so as to prevent the ink within the ink jet heads 21 to 24 from drying out.

The wiper 20 is disposed at the right side of the suction cap 25. The wiper 20 is connected with the suction unit 18. The wiper 20 wipes the nozzle faces 6*a* and 7*a* respectively. The wiper 20 does not move by itself in a left-right direction (in the X direction and its reverse direction). Instead, the movement of the carriage 8 in the left-right direction allows the wiper 20 to wipe the nozzle faces 6*a* and 7*a*. The wiper 20 can moves to the Z direction. The wiper 20 rises to a position where it makes contact with the nozzles 21*a* to 24*a*. When the wiper 20 is not wiping the nozzles 21*a* to 24*a*, the wiper 20 moves in the direction reverse to the Z direction.

The cam member 27 is disposed below the suction cap 25. The cam member 27 is joined via a clutch structure (not shown) with an LF motor 53 (not shown in FIG. 2, but shown in FIG. 3) that rotates the platen roller 3. The suction unit 18 is connected with the can member 27. The suction unit 18 can be moved upwards or downwards (in the Z direction or the reverse direction thereof) by operating the cam member 27. The wiper 20 is connected with the suction unit 18. Therefore, the wiper 20 also can be moved upwards or downwards by operating the cam member 27.

Operations realized by the maintenance mechanism 17 are following.

(1) The carriage 8 is moved to the maintenance mechanism 17 by the CR motor 10.

(2) When the nozzle face 6*a* has arrived at a position (a purge position) opposite the suction cap 25, the cam member 27 operates and the suction cap 25 rises. An upper face of the suction cap 25 therefore makes contact with the nozzle face 6*a*.

(3) Next, the purge pump 26 operates. The negative pressure generated by the purge pump 26 sucks away ink from the nozzles 21*a* and 22*a* The nozzles 21*a* and 22*a* can thus recover their ink discharging ability.

(4) The cam member 27 operates and the suction cap 25 descends temporarily.

(5) The CR motor 10 operates again, and the carriage 8 is moved so that the nozzle face 7*a* is in a position (a purge position) opposite the suction cap 25.

(6) The cam member 27 operates and the suction cap 25 rises. The upper face of the suction cap 25 therefore makes contact with the nozzle face 7*a*.

(7) The purge pump 26 operates. The negative pressure generated by the purge pump 26 sucks away ink from the nozzles 23*a* and 24*a*. The nozzles 23*a* and 24*a* can thus recover their ink discharging ability.

(8) While the printer is not used, the CR motor 10 moves the carriage 8 so that the nozzle faces 6*a* and 7*a* face to the cap parts 19*a* and 19*b*. Then the protection cap 19 rises (a mechanism for moving the protection cap 19 upward is not shown).

Figure 3:
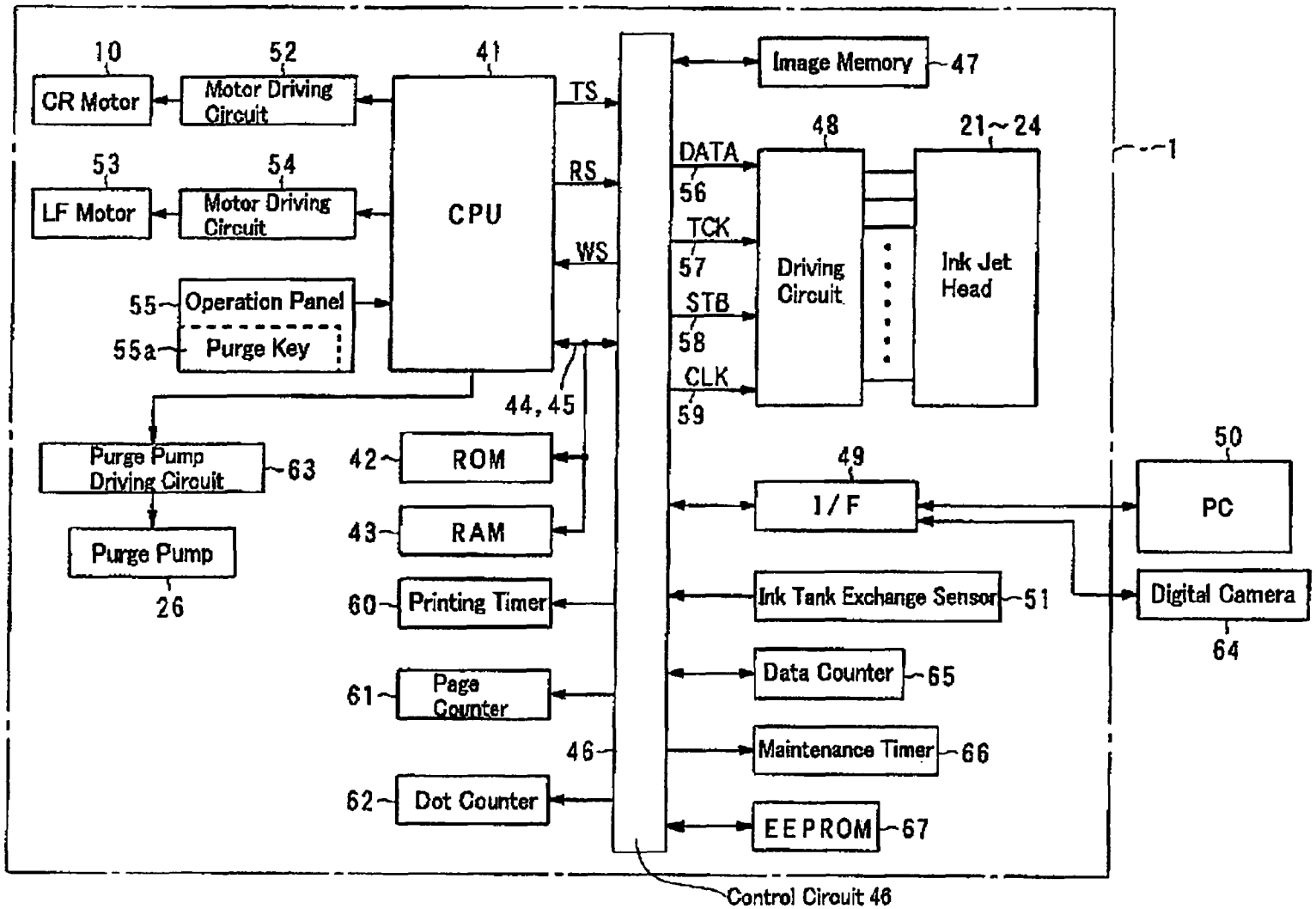
FIG. 3 shows a block diagram showing an electrical configuration of the ink jet printer.

FIG. 3 is a block diagram showing electrical configuration of the printer 1. The printer 1 comprises a CPU (Central Processing Unit) 41, a ROM 42, a RAM 43, etc. The CPU 41 executes processes using programs stored in the ROM 42. The ROM 42 stores programs and data necessary for steps executed by the CPU 41 (these programs will be described later, and are shown in the flow charts of FIGS. 4 to 9). The ROM 42 is a non-rewritable nonvolatile memory. The RAM 43 is a volatile memory in which various kinds of data may be stored. Furthermore, the printer 1 comprises an EEPROM 67. The EEPROM 67 is a nonvolatile memory in which various kids of data may be stored.

The printer 1 comprises a control circuit 46. The CPU 41, the ROM 42, the RAM 43, a printing timer 60, a page counter 61, a dot counter 62, an image memory 47, a driving circuit 48, a Centronics interface (Centronics I/F) 49, the ink tank exchange sensor 51, a data counter 65, a maintenance timer 66, and the EEPROM 67 are connected with the control circuit 46.

The CPU 41 is connected with the ROM 42 via an address bus 44 and a data bus 45. The CPU 41 is connected with the RAM 43 via the address bus 44 and the data bus 45. The CPU 41 can fetch information stored in the ROM 42 and the RAM 43. Further, the CPU 41 is connected with the EEPROM 67 via the address bus 44, the data bus 45, and the control circuit 46. The CPU 41 can therefore fetch information stored in the EEPROM 67. The EEPROM 67 stores a flag that marks whether an automatic maintenance action (to be described) will be executed. Moreover, the EEPROM 67 stores a flag that marks an automatic maintenance interval (a long interval, a normal interval, or a short interval).

The printing timer 60 counts the time that has elapsed since the last printing action was performed by the ink jet heads 21 to 24. The printing timer 60 is backed up by a battery or the like so that the elapsed time can be counted even when the printer 1 is stopped.

The page counter 61 counts the number of pages printed since the last automatic maintenance action.

The dot counter 62 counts the number of times that ink has been discharged from each of the ink jet heads 21 to 24. The 'number of times that ink has been discharged' is the number of droplets of the ink discharged from each of the in jet heads 21 to 24. The values stored by the dot counter 62 are cleared when the automatic maintenance action or a purge action (to be described) ends.

The data counter 65 counts contents printed since the last automatic maintenance action. Specifically, the data counter 65 sorts the contents into first data and second data based on ID attached to a printing data that has been input to the I/F 49. The first information comprises text data (character data), and the second information comprises data other than character data (image data). The data counter 65 counts and stores the number of pieces of text data T and the number of pieces of image data G. The values stored by the data counter 65 are cleared when the automatic maintenance action or the purge action ends.

The maintenance timer 66 counts the time that has elapsed since the last automatic maintenance action. The maintenance timer 66 is backed up by a battery or the like so that the elapsed time can be counted even when the printer 1 is stopped. The maintenance timer 66 is cleared when the automatic maintenance action or the purge action ends.

The CPU 41 can fetch the counter values from the printing timer 60, the page counter 61, the dot counter 62, the data counter 65, and the maintenance timer 66. This configuration allows the CPU 41 to supervise a printing state of the ink jet heads 21 to 24. The CPU 41 determines whether the automatic maintenance action should be executed. If the CPU 41 determines that the automatic maintenance action should be executed, the CPU 41 instructs a motor driving circuit 52, a motor driving circuit 54, and a purge pump driving circuit 63 to execute the automatic maintenance action.

The motor driving circuit 52, the motor driving circuit 54, an operation panel 55, and the purge pump driving circuit 63 are connected with the CPU 41. The motor driving circuit 52 drives the carriage (CR) motor 10. The motor driving circuit 54 drives the LF motor 53 that supplies rotating force to the platen roller 3. The operation panel 55 has a purge key 55*a*. A user may press the purge key 55*a* on the operation panel 55. When the purge key 55*a* is pressed, a signal representing this instruction (a purge command signal) is input to the CPU 41. Thereupon, the CPU 41 outputs a control signal to the purge pump driving circuit 63, thus driving the purge pump 26. The purge action is thus executed. Further, the user may use the operation panel 55 to select whether the maintenance action will be executed automatically. When the automatic maintenance action is selected or cancelled, the operation panel 55 outputs a signal representing this instruction (an automatic maintenance setting signal) to the CPU 41. The automatic maintenance setting signal may be output from the operation panel 55 when the user has executed the following operation. First, the user operates a menu key (not shown) of the operation panel 55, and further operates a scroll key (not shown) a plurality of times. Next, when a display (not shown) of the operation panel 55 has displayed 'Automatic maintenance ON?' or 'Automatic maintenance OFF?', the user operates a setting key (not shown), then the signal is output. That is, when the user operates the setting key when 'Automatic maintenance ON?' is displayed, the automatic maintenance signal representing the instruction to set automatic maintenance is output. When the user operates the setting key when 'Automatic maintenance OFF?' is displayed, the automatic maintenance signal representing the instruction to cancel automatic maintenance is output. The aforementioned display may comprise an LCD or the like.

A personal computer 50 or a digital camera 64 is connected with the centronics interface (I/F) 49. Data from the personal computer 50 or the digital camera 64 is fetched to the control circuit 46 via the I/F 49, The control circuit 46 stores this fetched data in the image memory 47.

The control circuit 46 comprises a gate array. The control circuit 46 generates an interrupt signal WS based on Centronics data delivered via the I/F 49, and delivers this interrupt signal WS to the CPU 41. The control circuit 46 inputs a controlling signal RS and a print timing signal TS output from the CPU 41. Signals for printing the data on the print medium P are output to the driving circuit 48 from the control circuit 46. These signals are generated based on the print timing signal TS, the controlling signal RS, and the data stored in the image memory 47. Specifically, the control circuit 46 generates and delivers the following to the driving circuit 48: printing data DATA, a transmission clock TCK that is synchronous with the printing data DATA, a strobe signal STB, and a printing clock CLK.

The driving circuit 48 is connected with the control circuit 46 by four harness cables 56 to 59. The aforementioned signals (DATA, TCK, STB, and CLK) are delivered via the harness cables 56 to 59.

The driving circuit 48 is connected with the ink jet heads 21 to 24. The driving circuit 48 drives the ink jet heads 21 to 24 based on the signals delivered from the control circuit 46.

Figure 4:
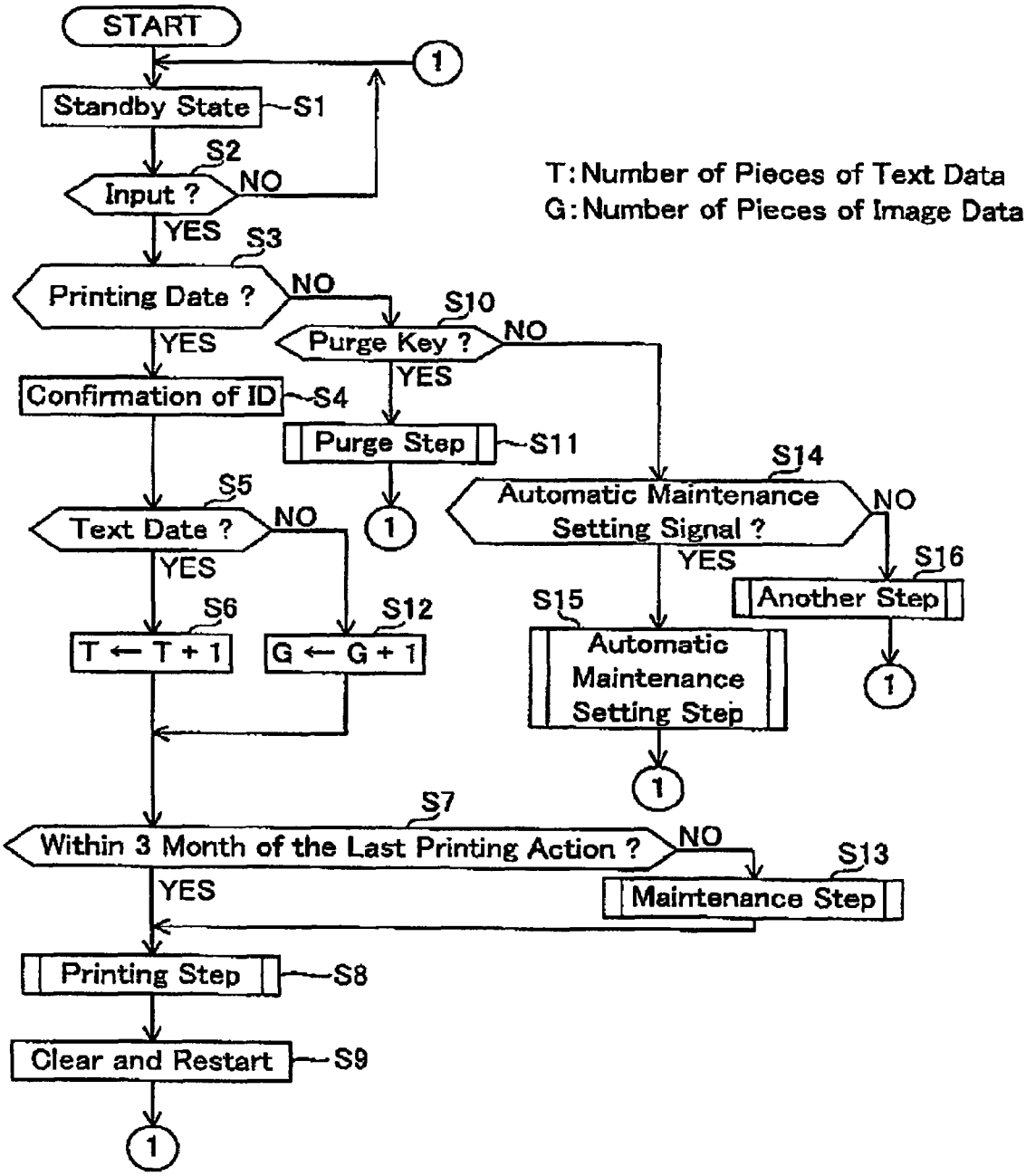
FIG. 4 shows a main flow chart of processes executed by the ink jet printer.

Next, the operation of the printer 1 of the present embodiment will be described by using the flow charts of FIGS. 4 to 9. The processes shown in FIGS. 4 to 9 are executed by the CPU 41, which controls various devices by operating in accordance with the programs stored in the ROM 42. FIG. 4 shows a flow chart of main processes executed by the CPU 41.

When a power source is turned ON, the printer 1 becomes a standby state (step S1. Below, step S1 will be termed 'S1', and the word 'step' will be omitted. The word 'step' will also be omitted for the other steps).

Next, it is checked whether any input signal has been input to the printer 1 (S2). The CPU 41 determines YES in S2 if, for example, a signal has been received from the operation panel 55. Furthermore, the CPU 41 determines YES in S2 if a signal output from an external apparatus such as the PC 50, the digital camera 64, etc. has been input via the I/F 49 and the control circuit 46. The standby state continues until YES is determined in S2.

When YES is determined in S2, the CPU 41 determines whether the signal input in S2 is printing data (S3). The CPU 41 determines YES in S3 if the signal output from the PC 50 or the digital camera 64 has been input. If YES is determined in S3, the process proceeds to S4. If NO is determined in S3, the process proceeds to S10.

When it has been determined that the input signal is printing data (S3 is YES), the CPU 41 detects the ID data attached to the printing data (S4). The CPU 41 determines whether the input printing data is text data based on the ID data that has been detected (S5). In the present representative embodiment, the 'ID data' is data showing whether the printing data is text data or data other than text data (image data).

When the CPU 41 determines that the printing data that has been input is text data (YES in S5), 1 is added to the number of pieces of text data T stored in the data counter 65 (S6). If the printing data that has been input is image data (NO in S5), 1 is added to the number of pieces of image data G stored in the data counter 65 (S12). When S6 or S12 has been executed, the process proceeds to S7.

In S7, it is determined how much time has elapsed between the present printing action and the last printing action. Specifically, the CPU 41 determines whether the time counted by the printing timer 60 exceeds three months. If YES is determined in S7, the CPU 41 executes a printing step of S8. If NO is determined in S7, the CPU 41 executes a maintenance step of S13, and then executes the printing step of S8. The printing step of S8 and the maintenance step of S13 will be described in detail later.

When the printing step (58) ends, the CPU 41 executes a termination step (S9). In the termination step (S9), the value in the printing timer 60 (i.e. the time since the last printing action) is cleared, and the printing timer 60 is restarted.

Next is a description of the processes which occur when NO is determined in S3. When NO is determined in S3, the process proceeds to SI1. In S30, it is determined whether the signal that has been input in S2 is the purge command signal. In the case where the user has operated the purge key 55*a*, the purge command signal is output from the operation panel 55 and is input to the CPU 41. If the purge command signal is input to the CPU 41, the CPU 41 determines YES in S10. When YES is determined in 510, the purge action is executed (S11). The purge step of S11 will be described in detail later.

When NO is determined in S11, it is determined whether the signal that has been input in S2 is the automatic maintenance setting signal (S14). In the case where the user has performed a predetermined operation of the operation panel 55, the automatic maintenance setting signal is output from the operation panel 55 and is input to the CPU 41. If the automatic maintenance setting signal is input to the CPU 41, the CPU 41 determines YES in S14. If YES is determined in S14, the CPU 41 executes the automatic maintenance setting step (S15). The automatic maintenance setting process of S15 will be described in detail later.

When NO is determined in S14, a process is executed that corresponds to the signal that has been input in S2 (S16). A detailed description of the processes of S16 has been omitted.

Figure 5:
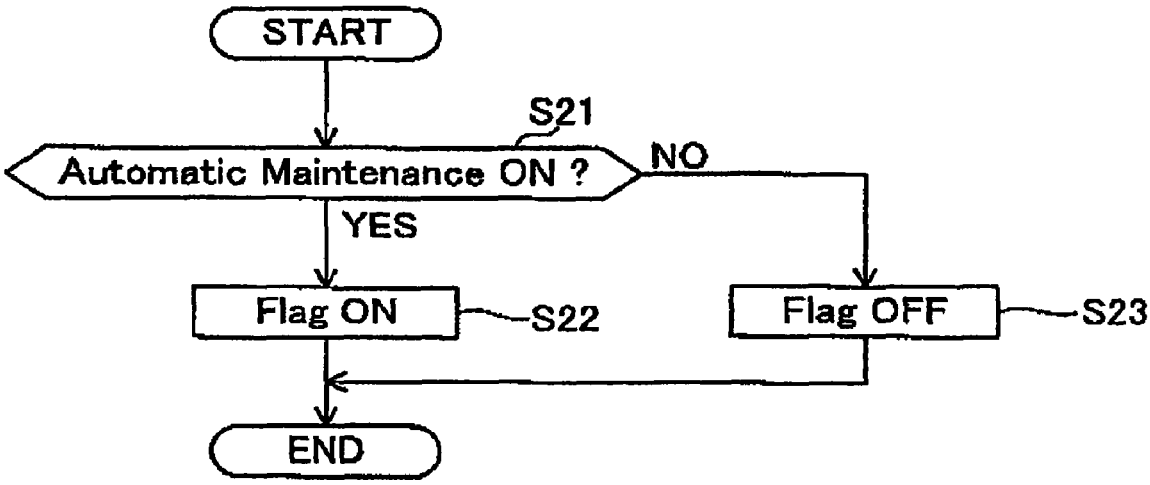
FIG. 5 shows a flow chart of processes for selecting whether an automatic maintenance will be executed.

Next, the automatic maintenance setting process (S15 in FIG. 4) will be described by using FIG. 5. FIG. 5 is a flow chart of the automatic maintenance setting step.

The CPU 41 determines whether the automatic maintenance setting signal represents the setting of the automatic maintenance action or the cancellation of the automatic maintenance action (S21). The CPU 41 determines S21 based on the content of the automatic maintenance set signal output from the operation panel 55.

When the automatic maintenance setting sign represents the setting of the automatic maintenance action (YES in S21), the CPU 41 sets the automatic maintenance flag of the EEPROM 67 to be ON (S22). Specifically, '1' is stored in a region of the EEPROM 67 for storing the automatic maintenance flag. On the other hand, when the automatic maintenance setting signal represents the cancellation of the automatic maintenance action that had been set earlier (NO in S21), the CPU 41 sets the automatic maintenance flag of the EEPROM 67 to be OFF (S23). '0' is stored in the region of the EEPROM 67 for storing the automatic maintenance flag.

Figure 6:
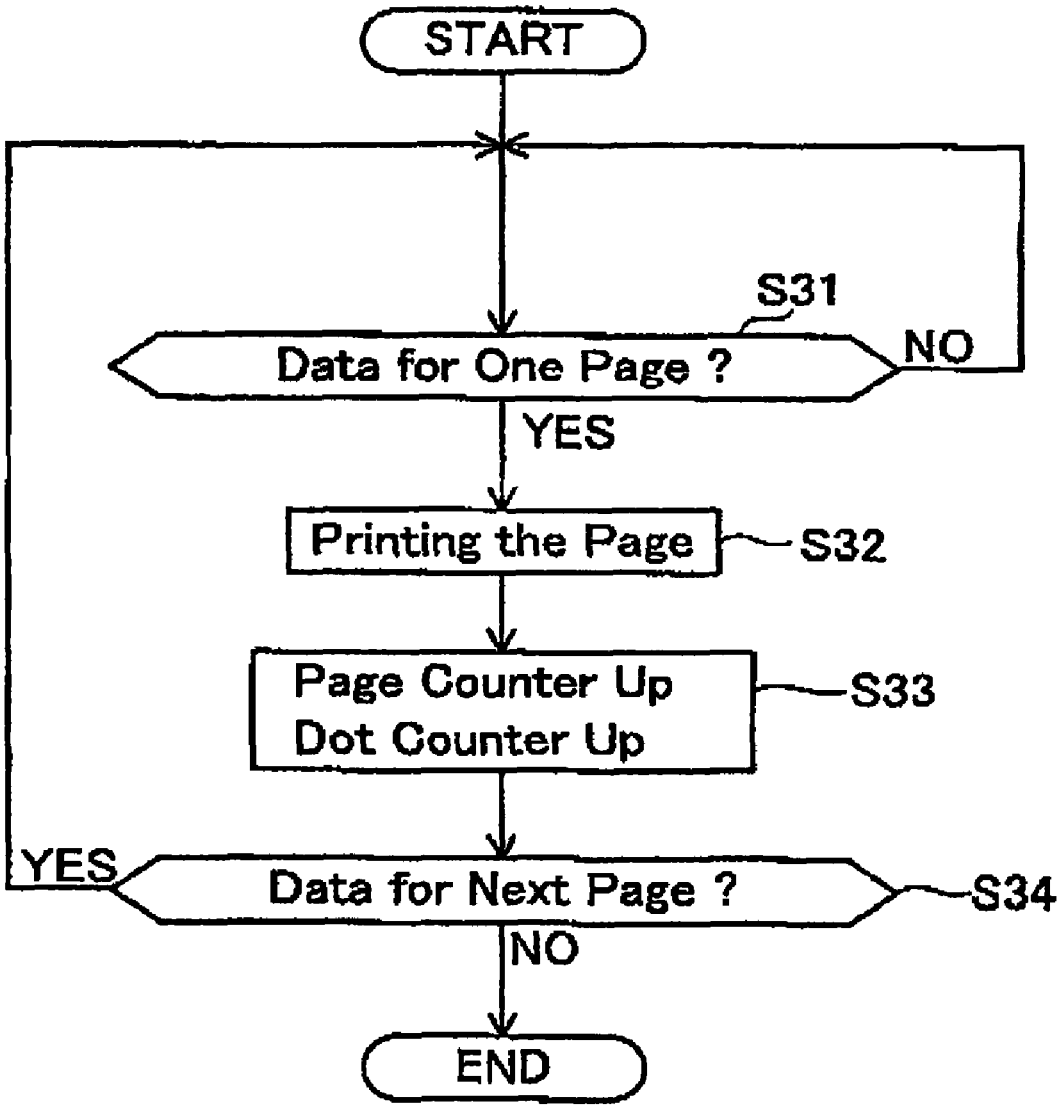
FIG. 6 shows a flow chart of processes for printing.

Next, the printing step (S8 in FIG. 4) will be described by using FIG. 6. FIG. 6 shows a flow chart of the printing step.

First, the CPU 41 determines whether the printing data input via the I/F 49 is a quantity of data equivalent to one page (S31). When it is determined that the printing data is less than one page (NO in S31), the standby state continues until further printing data is input. When the printing data is equivalent to one page, or when a termination code of tee page is present in the printing data, or when a termination code of the printing data is present, S31 is determined as YES.

When YES is determined in S31, a process is executed to print one page in accordance with the data (S32). That is, the CPU 41 sends the TS signal and the RS signal to the control circuit 46. The DATA signal, the TCK signal, the STB signal, and the CLK signal are therefore output from the control circuit 46. The signals output from the control circuit 46 are fetched by the driving circuit 48. The driving circuit 48 drives the ink jet heads 21 to 24.

When the process of S32 ends, the CPU 41 executes S33. In S33, the count value of the dot counter 62 is updated. The dot counter 62 counts the number of droplets of the ink discharged from each of the ink jet heads 21 to 24. When, for example, black ink is discharged from the ink jet head 21, the count value corresponding to the ink jet head 21 is increased. In this embodiment, if the driving circuit 48 outputs one signal to the ink jet head 21, the ink jet head 21 discharges one droplet of the ink. The dot counter 62 can count the number of signals output from the driving circuit 48 to the ink jet head 21. Therefore, the dot counter 62 can count the number of droplets of the ink discharged from the ink jet head 21. Similarly, the dot counter 62 can count the number of signals output from the driving circuit 48 to each of the ink jet head 22, 23, 24. The dot counter 62 can count the number of droplets of the ink discharged from each of the ink jet head 22, 23, 24. Further, in S33, 1 is added to the number of printed pages 'n' stored in the page counter 61. Moreover, the number of printed pages is counted without making a distinction between text data and image data.

Next, the CPU 41 determines whether printing data for a subsequent page is present (S34). When YES is determined in S34, the process returns to S31. When NO is determined in S34, the printing step (S8) ends.

Figure 7:
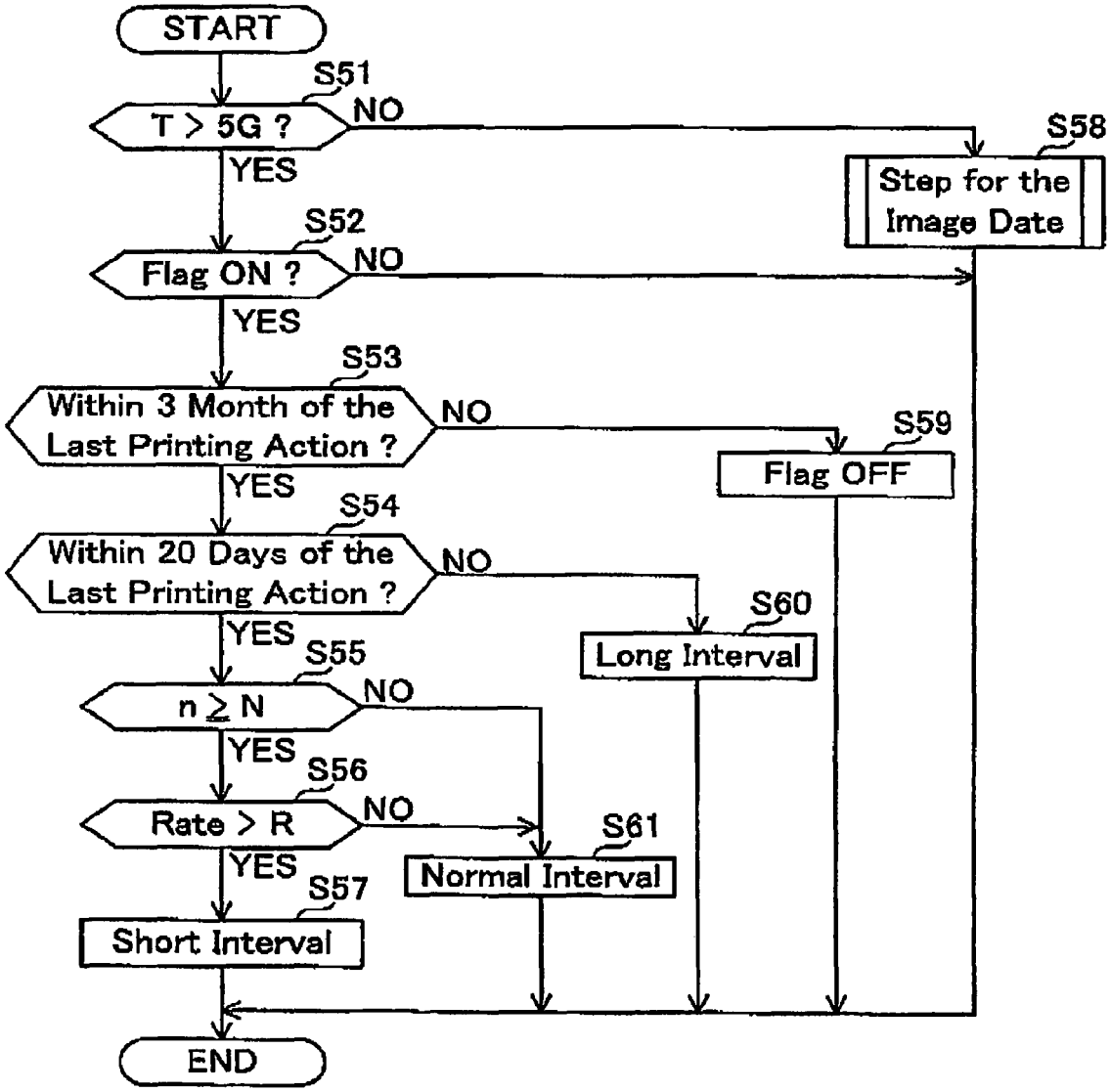
FIG. 7 shows a flow chart of processes for determining an automatic maintenance interval for text data.

The printer 1 of the present representative embodiment automatically sets an interval between the last automatic maintenance action and the next automatic maintenance action (this interval will hereafter be termed as an automatic maintenance interval). The process of setting the automatic maintenance interval will be described with reference to FIG. 7. FIG. 7 shows a flow chart showing the process of setting the automatic maintenance interval This process is executed by the CPU 41. The process of setting the automatic maintenance interval is executed at an interval which has been predetermined (e.g. ten minute intervals). The CPU 41 checks the operating state of the printer 1 and executes the process of setting the automatic maintenance interval when the printer 1 is not engaged in printing operation.

In the process of setting the maintenance interval, the CPU 41 first compares the number of pieces of text data T and the number of pieces of image data G (S51). The number of pieces of text data T and the number of pieces of image data C are counted by the data counter 65. The CPU 41 executes S51 by fetching the count value of the data counter 65. In 551, the CPU 41 determines whether T is greater than 5G. When T is greater than 5G, S51 is YES, and the process proceeds to S52. When T is less than 5G, S51 is NO, and the process proceeds to S58.

When the number of pieces of text data T is significantly greater than the number of pieces of image data G, it is considered that only one particular ink jet head out of the ink jet heads 21 to 24 (e.g. the ink jet head 21 used for black ink) is being used frequently. In this case, it is likely the ink will dry up and block the nozzles 22*a*, 23*a*, and 24*a* in the ink jet heads that arm not being used (e.g. the ink jet heads 22 to 24). By contrast, when there is a non-significant difference between the number of pieces of text data T and the number of pieces of image data 0, there is considered to be hardly any difference in the frequency of usage of the ink jet heads 21 to 24.

Figure 8:
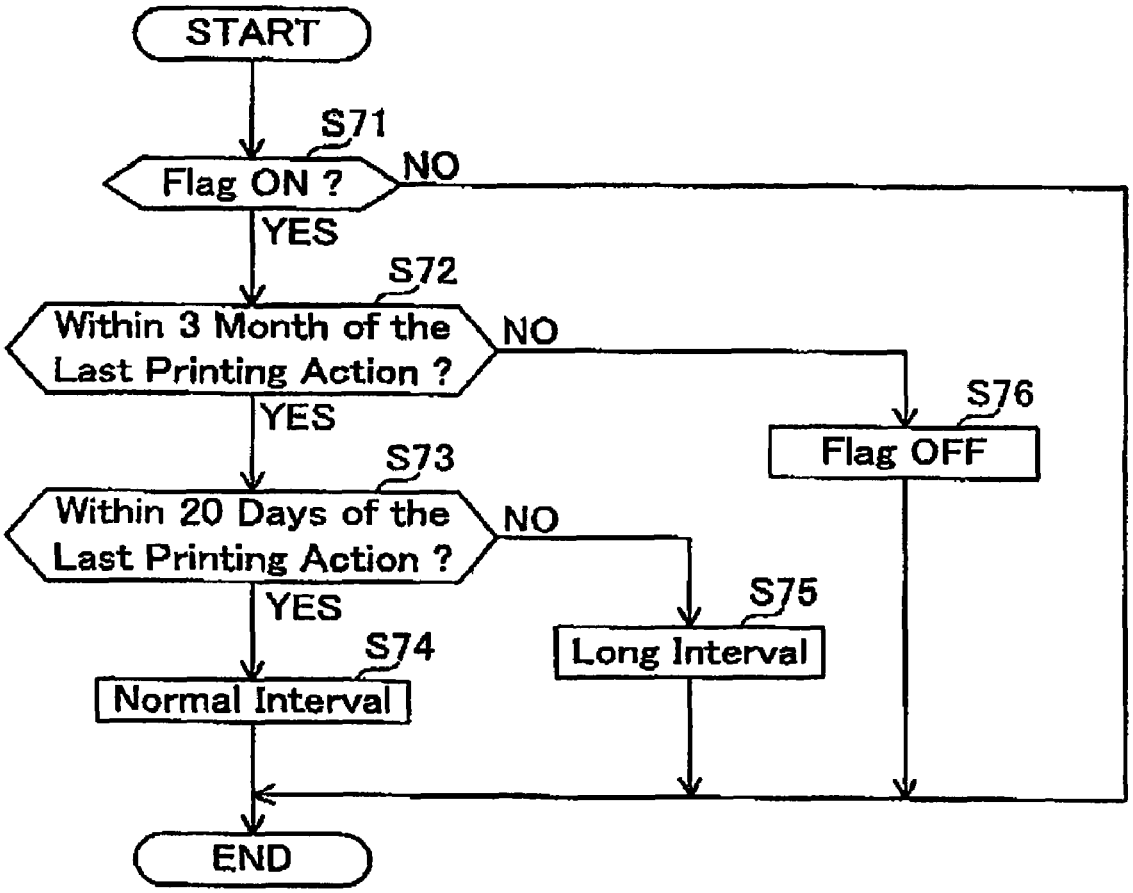
FIG. 8 shows a flow chart of processes for determining an automatic maintenance interval for image data.

In the present representative embodiment, there are differing processes for the case where only the ink jet head 21 is being used frequency, and for the case where this is not so. That is, when text data is printed frequently, YES is determined in S51, and the processes of S52 to S61 are executed. When image data is printed frequently, NO is determined in 5S1, and the process S58 is executed. The process S58 is shown in FIG. 8. This will be described in detail later.

When YES was determined in S51, the CPU 41 determines whether the automatic maintenance flag stored in the EEPROM 67 is ON (S52). When the automatic maintenance flag is not ON (NO in S52), the process of setting the maintenance interval is ended. The automatic maintenance flag becomes OFF when the user does not want the automatic maintenance action (S23 in FIG. 5), or when the printer 1 is not being used for printing for a long time (S59 or S76, described later).

When the automatic maintenance flag is ON (YES in S52), it is determined whether the time since the last printing action exceeds three months (S53). This is performed by reading the count value of the printing timer 60.

When it is determined that the time since the last printing action exceeds three months (NO in S53), the automatic maintenance flag of the EEPROM 67 is turned OFF (S59). This is performed for the following reason. The user has not used the printer 1 for a long time when S53 is NO. Since ink is discharged in the automatic maintenance action, it is not economical to perform regular automatic maintenance action of the printer 1 that is not being used. Consequently, the setting is changed so that the automatic maintenance action is not executed.

When the user wants to use the printer 1 after a long period of disuse, the maintenance step of FIG. 4 (S13) is performed before the printing step (S8) is executed. Since the maintenance process (S13) is performed immediately before the printing process (S8), the problem that the printing quality deteriorates due to the ink having dried up is solved. Further, the user can operate the purge key 55*a* of the operation panel 55 and thereby execute the purge action. This, also, eliminates the problem of deterioration in printing due to the ink having dried up. Turning the automatic maintenance flag OFF (S59) does not lead to deterioration in printing quality.

When it is determined that three months have not elapsed since the last printing action (YES in S53), it is determined whether the time since the last printing action exceeds twenty days (S54). This process is performed by reading the count value of the printing timer 60.

When it is determined that the time since the last printing action exceeds twenty days (NO in S54), the flag indicating the automatic maintenance interval is set to the long interval (S60). The flag indicating the automatic maintenance interval is stored in the EEPROM 67. Due to this setting, the automatic maintenance process is executed at the long interval.

When the CPU 41 has determined that the time since the last printing action is less than twenty days (YES in S54), it is determined whether the number of printed pages (n) is equal to or exceeds a predetermined number (N) (S55). When the number of printed pages is less than the predetermined number (NO in S55), the flag indicating the automatic maintenance interval is set to the normal interval (S61). Due to this setting, the automatic maintenance process is executed at the normal interval (shorter than the aforementioned long interval and longer than the short interval (to be described)).

When it is determined that the number of printed pages exceeds the predetermined number (YES in S55), the process of S56 is executed. The CPU 41 calculates the printing rate of each of the inkjet heads 21 to 24, and compares this to a predetermined rate (R) (S56). The printing rate is obtained by dividing the number of droplets of the ink discharged from the ink jet heads 21 to 24 by the number of printed pages (n). The number of droplets of the ink is stored in the dot counter 62. When the printing rate of any one of the ink jet heads 21 to 24 exceeds the predetermined rate (R), YES is determined in S56. When YES is determined in S56, the flag indicating the automatic maintenance interval is set to the short interval (S57). When all of the printing rates of the ink jet heads 21 to 24 are less than the predetermined rate (R) (NO in S56), the flag indicating the automatic maintenance interval is set to the normal interval (S61).

Next, S58 of FIG. 7 will be described with reference to FIG. 8. First, it is determined whether the automatic maintenance flag is ON (S71). The process of setting the maintenance interval is ended when the automatic maintenance flag is not ON (NO in S71).

When it is determined that the automatic maintenance flag is ON (YES in S71), the following process is performed to determine the automatic maintenance interval. First, the CPU 41 determines whether the time since the last printing action exceeds three months (S72). This process is performed by reading the count value of the printing timer 60.

When it is determined that the time since the last printing action exceeds three months (NO in S72), the automatic maintenance flag is turned OFF (S76). The automatic maintenance action will not be performed in the printer 1 that is not being used for a long period, and ink will therefore not be consumed.

When it is determined that the time since the last printing action is less than three months (YES in S72), it is determined whether the time since the last printing action exceeds twenty days (S73). When it is determined that the time since the last printing action exceeds twenty days (NO in S73), the automatic maintenance interval flag is set to the long interval (S75). Because the time since the last printing action exceeds twenty days, it is assumed that the user does not frequently use the printer 1. However, since printing has occurred within the three months since the last printing action, it is assumed that the user does not leave the printer 1 unused for a long time. It is sufficient to perform the automatic maintenance action at the long interval. The flag is set for the automatic maintenance to be performed at the long interval, and it is thus possible to decrease the quantity of ink consumed by the automatic maintenance action.

When it is determined that the time since the last printing action is less than twenty days (YES in S73), the automatic maintenance interval flag is set to the normal interval (S74). Since the user frequently performs printing, the flag is set for the automatic maintenance action to be performed at the normal interval. The ink jet heads 21 to 24 are thus maintained in a satisfactory state.

Figure 9:
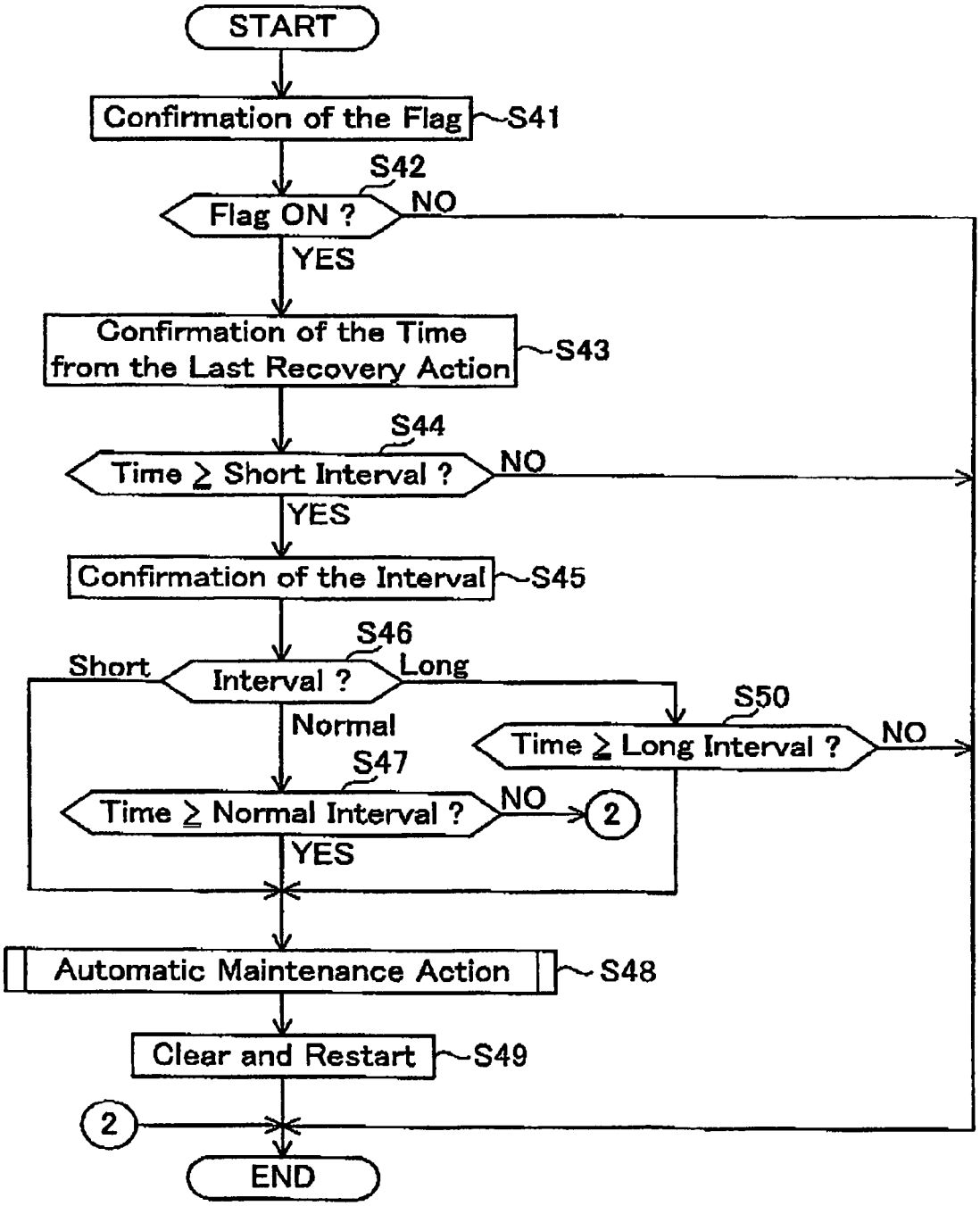
FIG. 9 shows a flow chart of processes for the automatic maintenance.

Next, the automatic maintenance step will be described with reference to FIG. 9. FIG. 9 shows a flow chart of the automatic maintenance step. The process of FIG. 9 is initiated with a predetermined timing (e.g. daily at any point between 11 to 12 a.m.). The process of FIG. 9 is initiated when the printer 1 is not engaged in the printing action. If the printer 1 is engaged in a printing action at the predetermined timing, the process of FIG. 9 is initiated after a predetermined time (e.g. ten minutes later).

First, the CPU 41 reads the automatic maintenance flag stored in the EEPROM 67 (S41). Then it is determined whether the automatic maintenance flag is ON (S42). When the automatic maintenance flag is OFF (NCO in S42), the automatic maintenance action is not executed, When the automatic maintenance flag is ON (YES in S42), the CPU 41 reads the time that has elapsed since the last automatic maintenance action (S43). This process is performed by reading the value from the maintenance timer 66.

When the CPU 41 has read the value of the maintenance timer 66, the CPU 41 determines whether this value (the elapsed time) exceeds the short interval (S44). When the elapsed time is less than the short interval (NO in S44), the automatic maintenance action is not executed. When the elapsed time exceeds the short interval (YES in S44), the CPU 41 reads the flag indicating the automatic maintenance interval that is stored in the EEPROM 67 (S45).

The CPU 41 determines whether the flag it has read in S45 is the short interval, the normal interval, or the long interval (S46). When the CPU 41 determines that the flag is the short interval (Short in S46), the automatic maintenance action is executed (S48). Specifically, the CPU 41 outputs a driving signal to the motor driving circuit 52 and 54. Therefore, the carriage 8 is moved, and the suction cap 2S makes contact with the nozzle face 6*a*. The CPU 41 outputs a driving signal to the purge pump driving circuit 63. Upon receiving this driving signal, the purge pump driving circuit 63 drives the purge pump 26. Negative pressure is applied to the nozzles 21*a* and 22*a* when the purge pump 26 is driven, and dried ink within the nozzles 21*a* and 22*a* is sucked away. Further, the same process is performed to the nozzles 23*a* and 24*a*. Dried ink within the nozzles 23*a* and 24*a* is sucked away.

Other normal nozzle cleaning operations are also executed in the automatic maintenance action (S48), i.e. cleaning the nozzles, purging, and flushing.

The process of S48 described here has the same content as S11 and S13 of FIG. 4.

When the CPU 41 determines that the flag is Normal in S46 (i.e., the flag indicating the automatic maintenance interval is set to the normal interval), the CPU 41 determines whether the time that has elapsed since the last automatic maintenance action—this information being stored in the maintenance timer 66—exceeds the normal interval (S47). When the elapsed time exceeds the normal interval (YES in S47), the automatic maintenance action is executed (S48). When the elapsed time is less than the normal interval (NO in S47), the automatic maintenance action (S48) is not executed.

When the CPU 41 determines that the flag is Long in S46 (i.e., the flag indicating the automatic maintenance interval is set to the long interval), the CPU 41 determines whether the time that has elapsed since the last automatic maintenance action—this information being stored in the maintenance timer 66—exceeds the long interval (S50). When the elapsed time exceeds the long interval (YES in S50), the automatic maintenance action is executed (S48). When the elapsed time is less than the long interval (NO in S50), the automatic maintenance action (S48) is not executed.

When the CPU 41 ends the automatic maintenance action (S48), a termination process (S49) is executed. Specifically, following processes are executed. (1) The value of the maintenance timer 66 is cleared. The maintenance timer 66 is restarted. (2) The number of pieces of text data T and the number of pieces of image data G stored in the data counter 65 are cleared. (3) The number of printed pages (n) stored in the page counter 61 is cleared (4). The values corresponding to each of the ink jet heads 21 to 24 stored in the dot counter 62 are cleared.

The following effects can be obtained with the above embodiment.

(1) The CPU 41 determines the interval of the automatic maintenance action based on a printing history of the ink jet printer 1 as shown in FIGS. 7 and 8. As a result, the automatic maintenance action is executed at intervals that correspond to the usage pattern of each user. Therefore, the number of unnecessary automatic maintenance actions can be reduced. It is therefore possible to prevent ink wastage. The running costs of the device can thus be reduced. Because the automatic maintenance actions are executed, it is possible to prevent deterioration in printing quality. The reliability of the device is improved.

(2) The automatic maintenance action can be executed at suitable intervals. When the time elapsed since the last recovering operation for recovering the ink discharging ability of the ink jet head becomes the selected interval, the recovering operation is repeated.

(3) When the time since the last printing action exceeds three months, the automatic maintenance Process (recovering operation for recovering the ink discharging ability of the inkjet head) is not executed. Wastage of ink can thus be reduced. When three months have been exceeded, the maintenance process (S13 of FIG. 4) is performed immediately before the next printing action, and consequently deterioration in printing quality can be prevented.

The maintenance step may also be omitted entirely after more than three months have elapsed. In this case, ink wastage can be reduced.

(4) When the time since the last printing action is within tree months but exceeds twenty days, the interval of the automatic maintenance action is set to the long interval. The number of unnecessary automatic maintenance actions can thus be reduced.

(5) When the time since the last printing action is within twenty days, the interval of the automatic maintenance action is set to the normal or short interval. Since the automatic maintenance action is being executed at the relatively short interval, the ink jet heads 21 to 24 can be maintained in a usable state.

(6) The CPU 41 can determine a suitable interval based on the number of printed pages (n) counted by the page counter 61.

(7) The CPU 41 sets the interval of the automatic maintenance action to the short or normal interval based on the number of printed pages. Since the automatic maintenance action is executed at the relatively short interval, the ink jet heads 21 to 24 can be maintained in a usable state.

(8) The CPU 41 can determine a suitable interval of the automatic maintenance action based on the printing rate.

(9) When the printing rate exceeds the predetermined rate A), the interval of the automatic maintenance action is set to the short interval. Since the automatic maintenance action is executed at the short interval, the ink jet heads 21 to 24 can be maintained in a usable state. Basically, the black ink is easy to dry up. Therefore, if the black ink is used frequently (that is, the text data is printed frequently), the automatic maintenance action should be executed frequently to maintain the high quality printing. In the above embodiment, if the text data is printed frequently, the interval of the automatic maintenance action is relatively short (there is the short interval in FIG. 7, but there is no short interval in FIG. 8). A suitable interval of the automatic maintenance action can be determined.

(10) The CPU 41 controls the interval of the automatic maintenance action based on the number of pieces of text data T and the number of pieces of image data C counted by the data counter 65. A suitable interval of the automatic maintenance action can thus be determined. There is a possibility that the user can not read the text printed on the print medium if the printing quality is bad. Therefore, the high printing quality is required when the text data is printed. On the other hand, if the printing quality of the image data is not so good, the user can recognize the image. Therefore, the high printing quality is not required strictly when the image data is printed. If the text data is printed frequently, the automatic maintenance action should be executed frequently to maintain the high printing quality. In above embodiment, if the text data is printed frequently, the interval of the automatic maintenance action is relatively short (there is the short interval in FIG. 7, but there is no short interval in FIG. 8). A suitable interval of the automatic maintenance action can be determined.

(11) When image data is printed frequently, the CPU 41 deters a suitable interval of the automatic maintenance action based on the time that has elapsed since the last printing action.

(12) When image data is printed frequently and the time that has elapsed since the last printing action exceeds three months, the CPU 41 prevent the automatic maintenance action. Ink wastage can thus be reduced. When three months have been exceeded, the maintenance process is performed immediately before the next recording action (S13 of FIG. 4), and consequently a deterioration in printing quality can be prevented.

(13) When the time since the last printing action is within three months but exceeds twenty days, the CPU 41 sets the interval of the automatic maintenance action to the long interval. The number of unnecessary automatic maintenance actions can thus be reduced.

(14) When the time since the last printing action is within twenty days, the CPU 41 sets the interval of the automatic maintenance action to the normal interval. A suitable interval is thus set.

(15) When the operation panel 55 is used to prevent the automatic maintenance action, the CPU 41 does not execute the automatic maintenance action. Ink can thus be saved.

(16) In the present representative embodiment, there is no need of complex controls to control discharge pressure of the ink, discharge speed of the ink, etc. The aforementioned effects can be obtained with a simple configuration using the above embodiment. The manufacturing cost of components can therefore be reduced.

The aforementioned representative embodiment may be varied in the following ways.

(1) In the aforementioned representative embodiment, the automatic maintenance action is described as a purge process of the ink jet heads. However, flushing of the ink jet heads may be adopted in place of the purge process. Further, both purging and flushing may be adopted. Flushing is the action that the ink jet head discharges ink.

(2) In the case where, for example, only a particular ink jet head requires the maintenance, only the particular ink jet head may be recovered. This configuration can be adopted in which all of inkjet heads can not be purged simultaneously.

(3) In the aforementioned representative embodiment, the main characteristic is that the intervals of the automatic maintenance action can be varied based on the printing history of the printer. However, both the intervals of the automatic maintenance action and the content of this action may be varied. For example, in the case where the interval is longer, the purge pressure of the purge pump 26 may be increased. For example, also, in the case where the interval is longer, the purge time may be longer. For example, as well, in the case where the interval is longer, the number of purges may be increased.

(4) In the aforementioned representative embodiment, the printing timer 60 and the maintenance timer 66 are represented as configurations separate from the CPU 41 (see FIG. 3). However, the time that has elapsed since the last printing action and/or the time that has elapsed since the last maintenance action may be measured using a timer within the CPU 41. Since one piece of hardware performs a plurality of functions, the cost of the device can be reduced.

(5) In the aforementioned representative embodiment, the printing timer 60 is reset every time the printing action occurs. However, the time that has elapsed since the last printing action way be obtained by calculating the difference between the last printing time and the present time. This is equivalent to measuring the time that has elapsed since the last printing action.

Furthermore, the time that has elapsed since the last maintenance action may be obtained by calculating the difference between the time the automatic maintenance action was last executed and the present time. This is equivalent to measuring the time that has elapsed since the last maintenance action.

(6) The technique of the present representative embodiment may be applied not only to machines with a printer function, but also to machines with a fax function, a scanner function, a copy function, a video printer function, etc.

(7) A color printer having a plurality of ink cartridges is used in the above embodiment. However, a single color printer having only one ink cartridge can be used.

(8) The programs corresponding to any of the flow charts in FIGS. 4 to 9 can be recorded onto a recording medium such as a floppy disc, etc., and can be read and executed by a computer such as a microcomputer in the printer, etc. Further, the programs corresponding to any of the flow charts in FIGS. 4 to 9 can be fetched and stored in the printer via a network such as the internet, etc.

(9) The technique taught in the present representative embodiment can be applied to ink jet printers employing the bubble jet (registered trademark) or piezo (piezoelectric element) ink discharge methods.

(10) In the above embodiment, the printing rate is adopted. However, the number of droplets of the ink discharged from the ink jet head may be adopted instead of the printing rate.

(11) The technique taught in the present representative embodiment is suitable for an ink jet printer with an automatic maintenance function. However, the technique taught in the present representative embodiment is not restricted to devices having only the function of an ink jet printer. The technique can be applied to various devices which execute an automatic maintenance operation. For example, the present technique can also be used in ink jet printers provided with any of: a fax function, a scanner function, a copy function, a video printer function, etc.

What is claimed is:

1. An ink jet printer comprising:

an ink jet head for discharging ink;

a recovery device for executing a recovery action to recover an ink discharging ability of the inkjet head;

a first timer for measuring time since a last recovery action of the recovery device; and a controller for setting an interval, the interval being selected from a plurality of predetermined intervals, between recovery actions based on a printing history of the ink jet printer, and for controlling the recovery device to execute the recovery action when the time measured by the first timer becomes equal to the set interval;

a first counter for counting a number of media printed since the last recovery action, and a second counter for counting a number of droplets of the ink discharged from the ink jet head since the last recovery action, wherein the controller calculates a printing rate by dividing the number of droplets of the ink by the number of printed media, and the controller sets the interval based on the printing rate.

2. The ink jet printer as in claim 1, further comprising:

a second timer for measuring time since a last printing action of the ink jet printer, wherein the controller sets the interval based on the time measured by the second timer.

3. The ink jet printer as in claim 2, wherein the controller prevents the recovery device from executing the recovery action if the time measured by the second timer exceeds a first predetermined time.

4. The ink jet printer as in claim 3, wherein if the time measured by the second timer exceeds the first predetermined time, the controller prevents the recovery device from executing the recovery action until immediately before a next printing action.

5. The ink jet printer as in claim 2, wherein the controller sets the interval in accordance with a relation that the interval is longer when the time measured by the second timer is longer.

6. The ink jet printer as in claim 1, wherein the controller sets the interval in accordance with a relation that the interval is shorter when the printing rate is greater.

7. The ink jet printer as in claim 1, further comprising:

a third counter for counting a number of pieces of text data printed by the ink jet printer since the last recovery action and for counting a number of pieces of image data printed by the ink jet printer since the last recovery action, wherein the controller sets the interval based on the number of pieces of text data and the number of pieces of image data.

8. The ink jet printer as in claim 7, wherein the controller sets either the interval for the text data if a ratio of the number of pieces of text data and the number of pieces of image data is within a predetermined range, or the interval for the image data if the ratio is not within the predetermined range.

9. The ink jet printer as in claim 1, wherein a user of the ink jet printer can select either a first mode or a second mode, the controller prevents the recovery device from executing the recovery action while the first mode is being selected, and the controller permits the recovery device to execute the recovery action while the second mode is being selected.

10. A method for controlling an ink jet printer, the ink jet printer comprising an ink jet head for discharging ink and a recovery device for executing a recovery action to recover an ink discharging ability of the ink jet head, the method comprising:

a step of setting an interval, the interval being selected from a plurality of predetermined intervals, between recovery actions based on a printing history of the ink jet printer;

a step of counting a number of media printed since the last recovery action;

a step of counting a number of droplets of the ink discharged from the ink jet bead since the last recovery action; and a step of calculating a printing rate by dividing the number of droplets of the ink by the number of printed media;

wherein in the setting step, the interval is set based on the printing rate.

11. The method as in claim 10, further comprising:

a step of measuring time since a last recovery action of the recovery device; and a step of controlling the recovery device to execute the recovery action when the time since the last recovery action becomes equal to the set interval.

12. The method as in claim 10, further comprising:

a step of measuring time since a last printing action of the ink jet printer, wherein in the setting step, the interval is set based on the time since the last printing action.

13. The method as in claim 12, further comprising:

a step of preventing the recovery device from executing the recovery action if the time since the last printing action exceeds a first predetermined time.

14. The method as in claim 10, further comprising:

a step of permitting a user of the ink jet printer to select either a first mode or a second mode;

a step of preventing the recovery device from executing the recovery action while the first mode is being selected; and a step of permitting the recovery device to execute the recovery action while the second mode is being selected.

15. A method for controlling an ink jet printer, the ink jet printer comprising an ink jet head for discharging ink and a recovery device for executing a recovery action to recover an ink discharging ability of the ink jet head, the method comprising:

a step of setting an interval, the interval being selected from a plurality of predetermined intervals, between recovery actions based on a printing history of the ink jet printer;

a step of counting a number of pieces of text data printed by the ink jet printer since a last recovery action; and a step of counting a number of pieces of image data printed by the ink jet printer since the last recovery action, wherein in the setting step, the interval is set based on the number of pieces of text data and the number of pieces of image data.

16. The method as in claim 15, wherein in setting step, the interval for the text data is set if a ratio of the number of pieces of text data and the number of pieces of image data is within a predetermined range, and the interval for the image data is set if the ratio is not within the predetermined range.

* * * * *